US007153181B2

(12) United States Patent
Cheng et al.

(10) Patent No.: US 7,153,181 B2
(45) Date of Patent: Dec. 26, 2006

(54) TOY SUPPORT STRUCTURE

(75) Inventors: Huang-Yi Cheng, Chia Tai Industrial Tai Pao (TW); Chi-Yung Lin, Chia Tai Industrial Tai Pao (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 11/059,513

(22) Filed: Feb. 16, 2005

(65) Prior Publication Data

US 2005/0181701 A1 Aug. 18, 2005

(30) Foreign Application Priority Data

Feb. 18, 2004 (TW) ..... 93202332 U

(51) Int. Cl.
*A63H 33/00* (2006.01)

(52) U.S. Cl. ..... 446/227; 446/228

(58) Field of Classification Search ..... 446/126, 446/227–228

See application file for complete search history.

(56) References Cited

U.S. PATENT DOCUMENTS

D367,788 S * 3/1996 Lawhorn ..... D6/491
6,296,415 B1 * 10/2001 Johnson et al. ..... 403/170
6,464,555 B1 * 10/2002 Paduano ..... 446/227
6,467,107 B1 * 10/2002 Glover et al. ..... 5/99.1

* cited by examiner

*Primary Examiner*—Nini F. Legesse
(74) *Attorney, Agent, or Firm*—Alan D. Kamrath; Nikolai & Mersereau, P.A.

(57) ABSTRACT

A toy support structure includes, a plurality of pivots provided on a center housing such that each axle center of the pivots is parallel to the axle center of center housing. By rotatably connecting the pivots and the hanging support set, the hanging support set can rotate in relation to the pivots so as to extend in radial form. Further, the hanging support set can rotate in relation to the pivots so as to be arranged in parallel on the same plane, thereby reducing the volume and accomplishing the ease of carrying and storage.

9 Claims, 6 Drawing Sheets

TOY SUPPORT STRUCTURE

FIELD OF THE INVENTION

The present invention relates to a toy support structure. A plurality of pivots having axle centers parallel to the axle center of a center housing are provided on the center housing. When folding the toy support structure, the hanging support set can rotate in relation to the pivots and be arranged in juxtaposition for placement by rotatably connecting the hanging support set and the pivots, thereby saving some storage space and providing convenience of carrying.

BACKGROUND OF THE INVENTION

Generally, adults will limit a baby to play inside a playpen when the baby has yet to learn how to walk, and when the adults cannot take care of the baby and protect the baby from danger. In order to keep the baby playing quietly inside the playpen, the adults will usually prepare some toys for the baby to play with. Besides placing the toys in the playpen, the toys can also be hung on a toy support structure. The conventional toy support structure as shown in the U.S. Pat. No. 6,296,415, consists of a hub and a plurality of struts. When in use, the struts are extended in radial form from the pivot portions of the hub, thereby allowing a user to hang toys. When the user is to fold the toy structure, the hub can be rotated so that each strut points downward and thus the struts are arranged in circular form. However, the hub still has a certain volume and thus the conventional foldable toy support structure still possesses the problem of having a large volume since the support set is still arranged circularly at the hub.

SUMMARY OF THE INVENTION

The main aspect of the present invention is to overcome the problem of occupying too much space after the toy support structure is folded and arranged in circular form. The present invention provides a toy support structure with less volume after folding. The toy support structure includes a center housing having a number of pivots corresponding to the number of struts on the sides. By rotatably connecting the pivots and the hanging struts, the axle center of the pivots can be turned to an extended position so as to hang toys, since the axle center of the pivots and that of the center housing are in parallel. When the hanging support structure is to be folded, the hanging support set can rotate in relation to the pivots such that the hanging support set can be arranged in parallel form on the same plane, thereby accomplishing the goal of reducing the volume of the toy support structure after being folded.

DETAILED DESCRIPTION OF THE EMBODIMENTS

Figure 1:
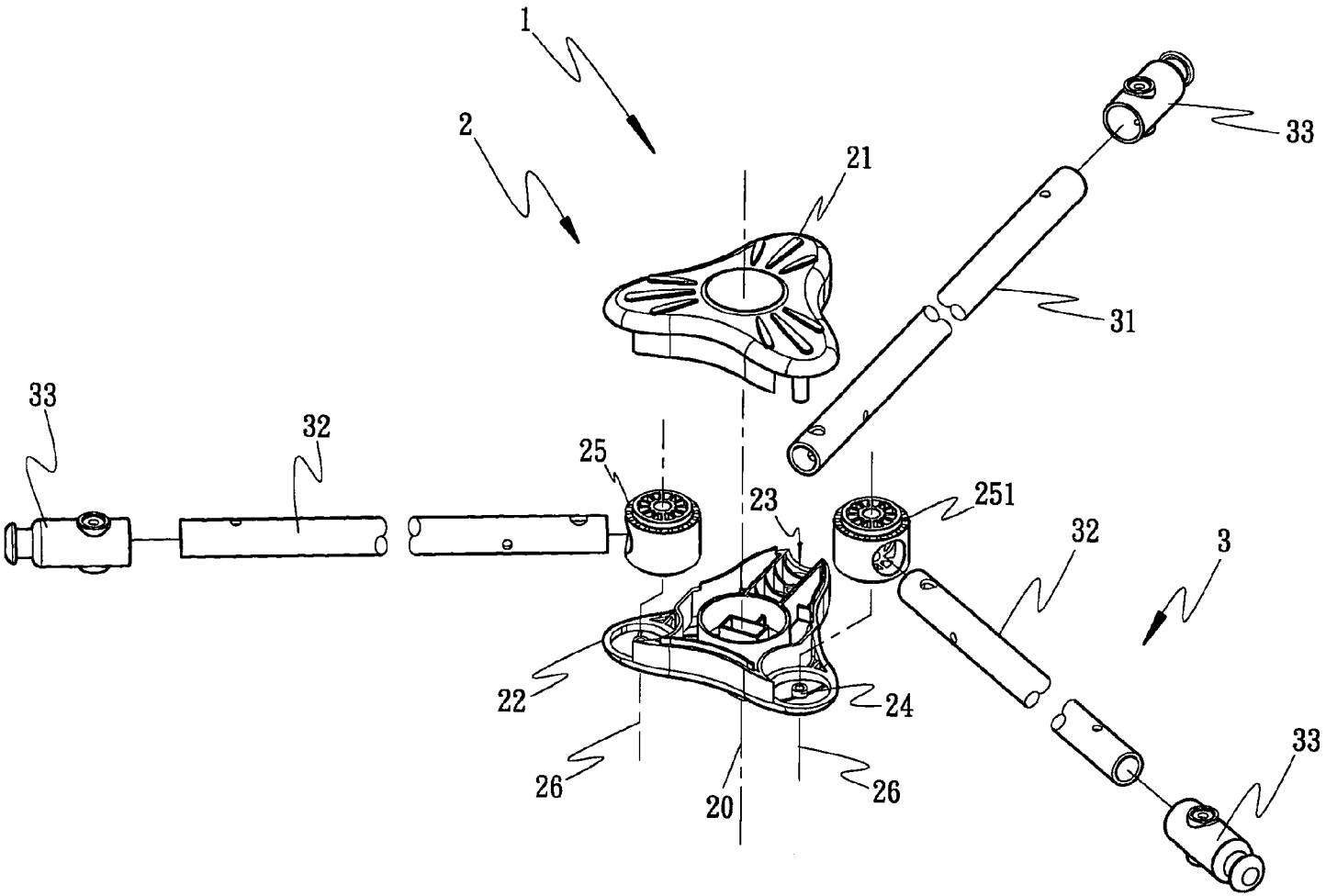
FIG. 1 is an exploded view of a structure in accordance with the present invention.
Figure 2:
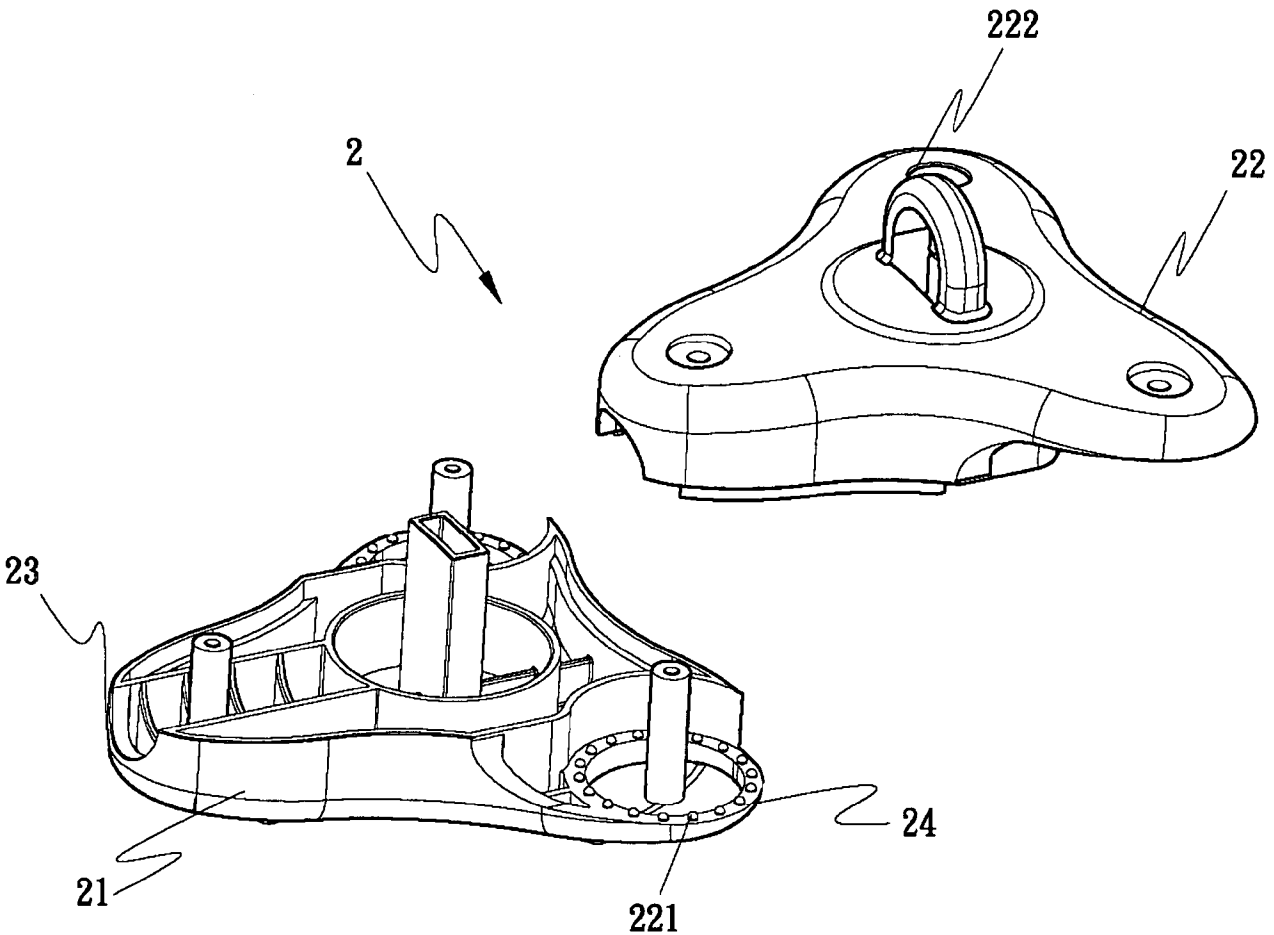
FIG. 2 is an exploded view of a center housing in accordance with the present invention.
Figure 3:
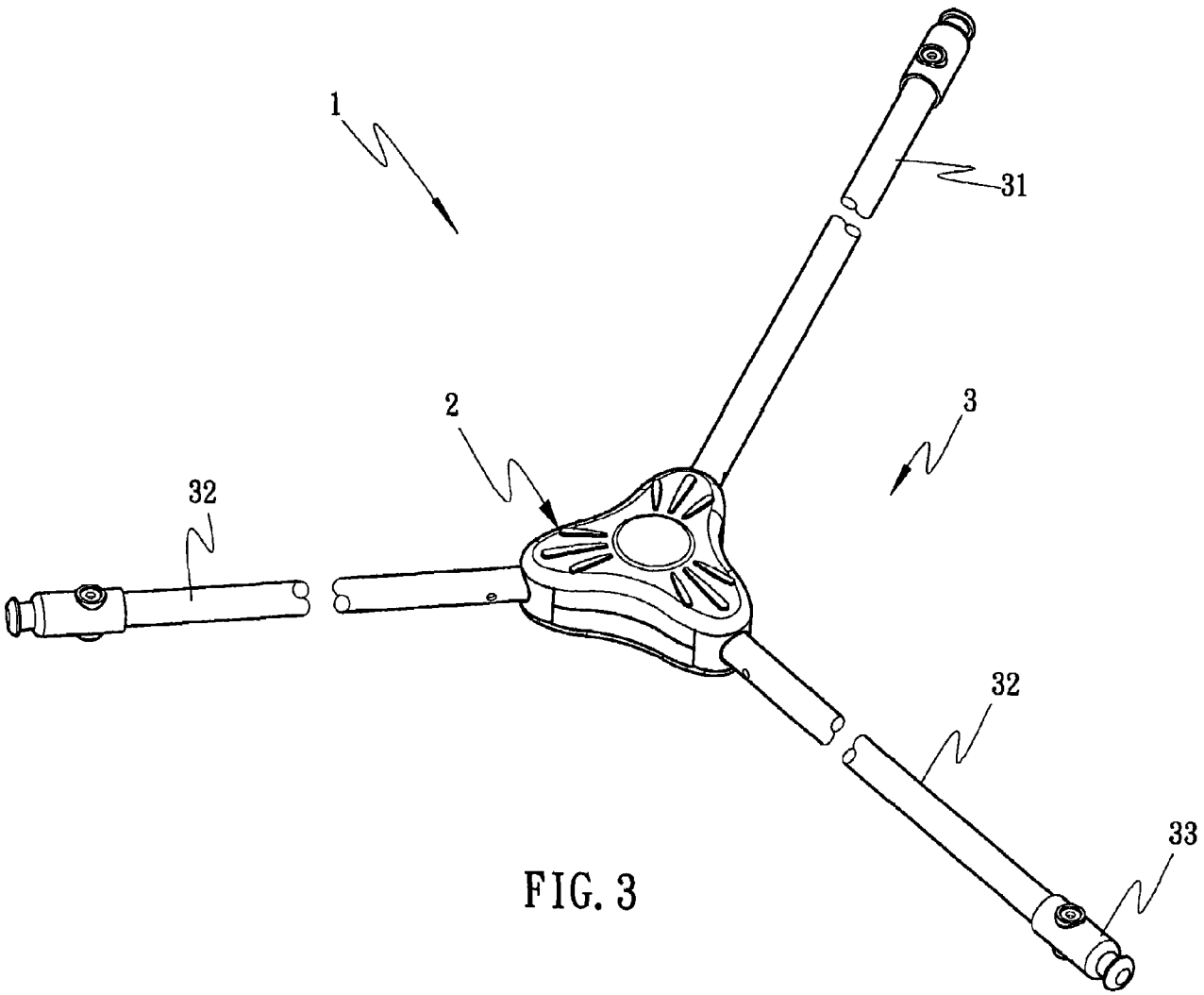
FIG. 3 is a three dimensional view of an extended assembly in accordance with the present invention.
Figure 6:
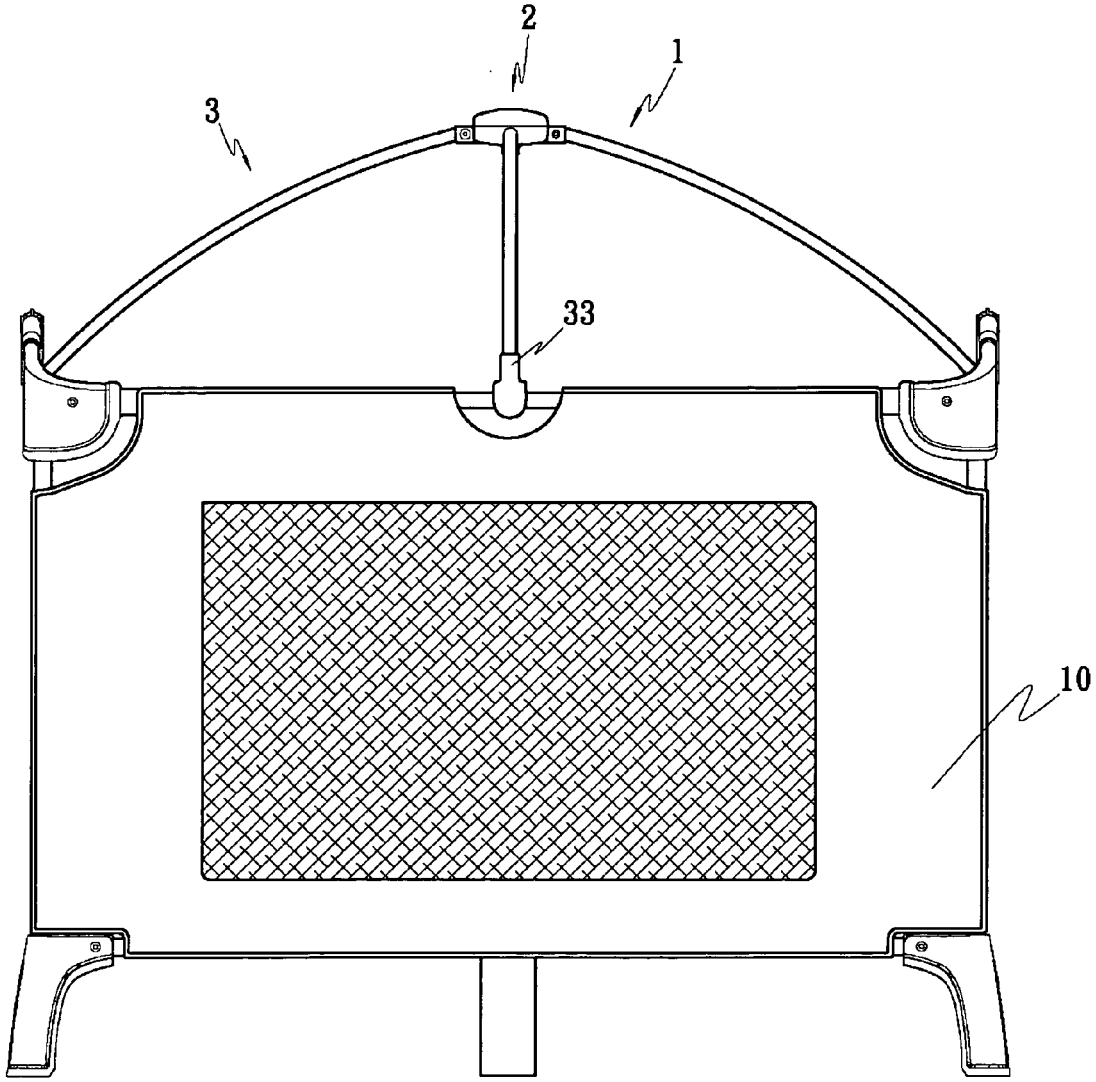
FIG. 6 is a schematic view of an embodiment of a playpen in accordance with the present invention.

Refer to FIGS. 1, 2, and 3. The present invention is a toy support structure 1 for allowing a user to place it on other devices, such as a playpen 10. The toy support structure 1 is used to hang toys for a baby to play with (as shown in FIG. 6). The toy support structure 1 in accordance with the present invention can include a center housing 2 and a hanging support set 3.

The center housing 2 includes an upper housing 21 and a lower housing 22. In the embodiment, securing grooves 23 are provided in the lower housing 22, and connecting portions 24 are provided at the two sides of the securing groove 23 with equal distance. The connecting portions 24 can rotatably connect to pivots 25. Furthermore, the axle center 26 of the pivots 25 is parallel to the axle center 20 of the center housing 2. When the upper housing 21 covers the lower housing 22, the pivots 25 can rotate at the connecting portions 24. Also, positioning grooves 251 with a circular arrangement are provided on the pivots 25. By engaging the positioning grooves 251 and protrusions 221 in the same circular arrangement on the upper housing 21, the positioning of the rotation of the pivots 25 can be controlled. Additionally, a hanging portion 222 is provided on the bottom of the lower housing 22 for hanging toys.

A hanging support set 3 includes a fixed hanging strut 31 and moveable hanging struts 32. One end of the fixed hanging strut 31 is fixedly connected to the securing grooves 23 of the center housing 2. One, end of the moveable struts 32 is connected to the pivots 25 so as to rotate in relation to the connecting portions 24. Another end of the hanging support set 3 is provided with a connecting element 33 for connecting an object such as a playpen 10. Since the hanging support set 3 is an elastic hollow tube, the hanging support set 3 can be bent to an arc shape after connecting to other objects so as to allow a user to hang toys for the baby to play with.

Figure 4:
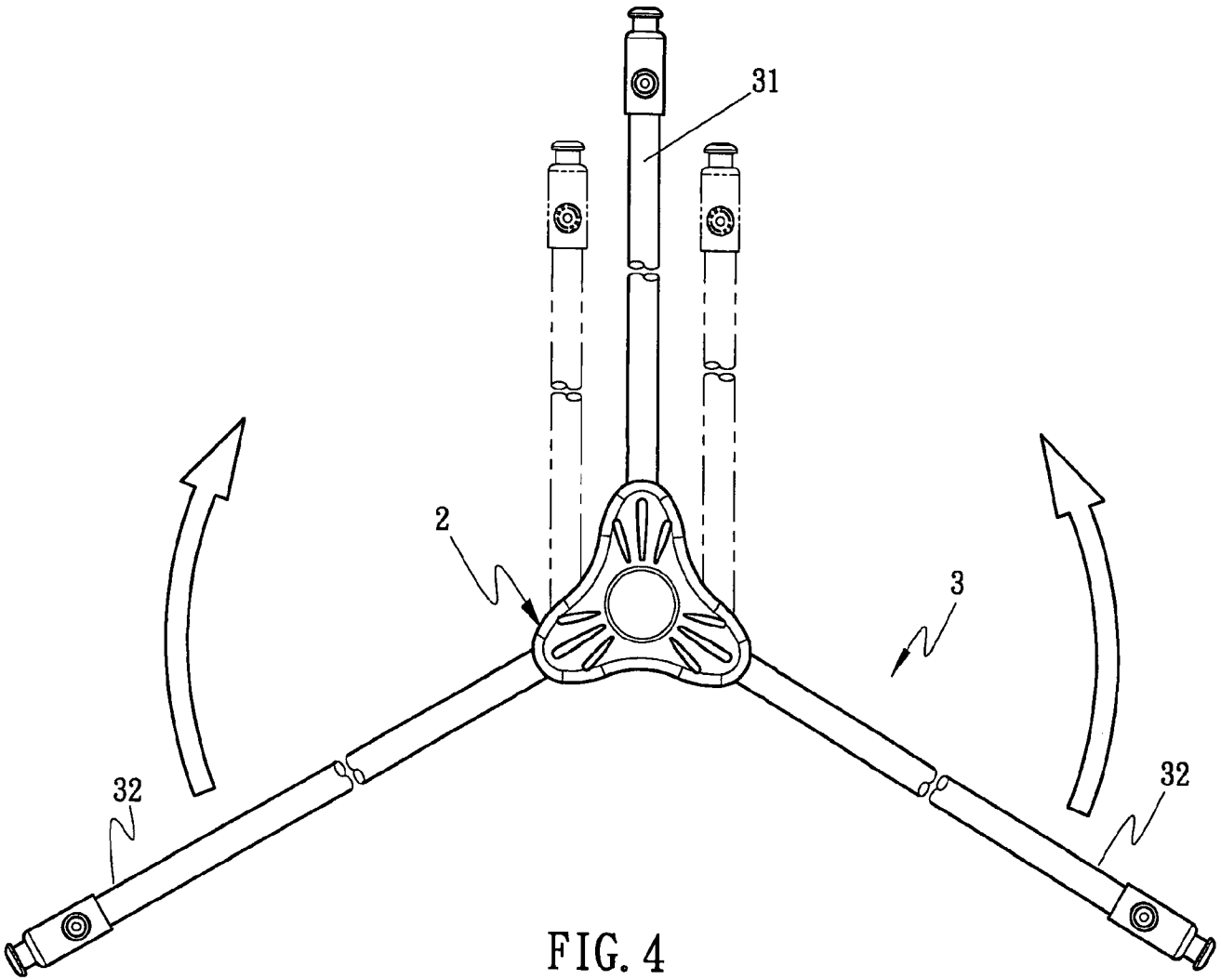
FIG. 4 is a schematic view of a folding movement of a hanging support set in accordance with the present invention.
Figure 5:
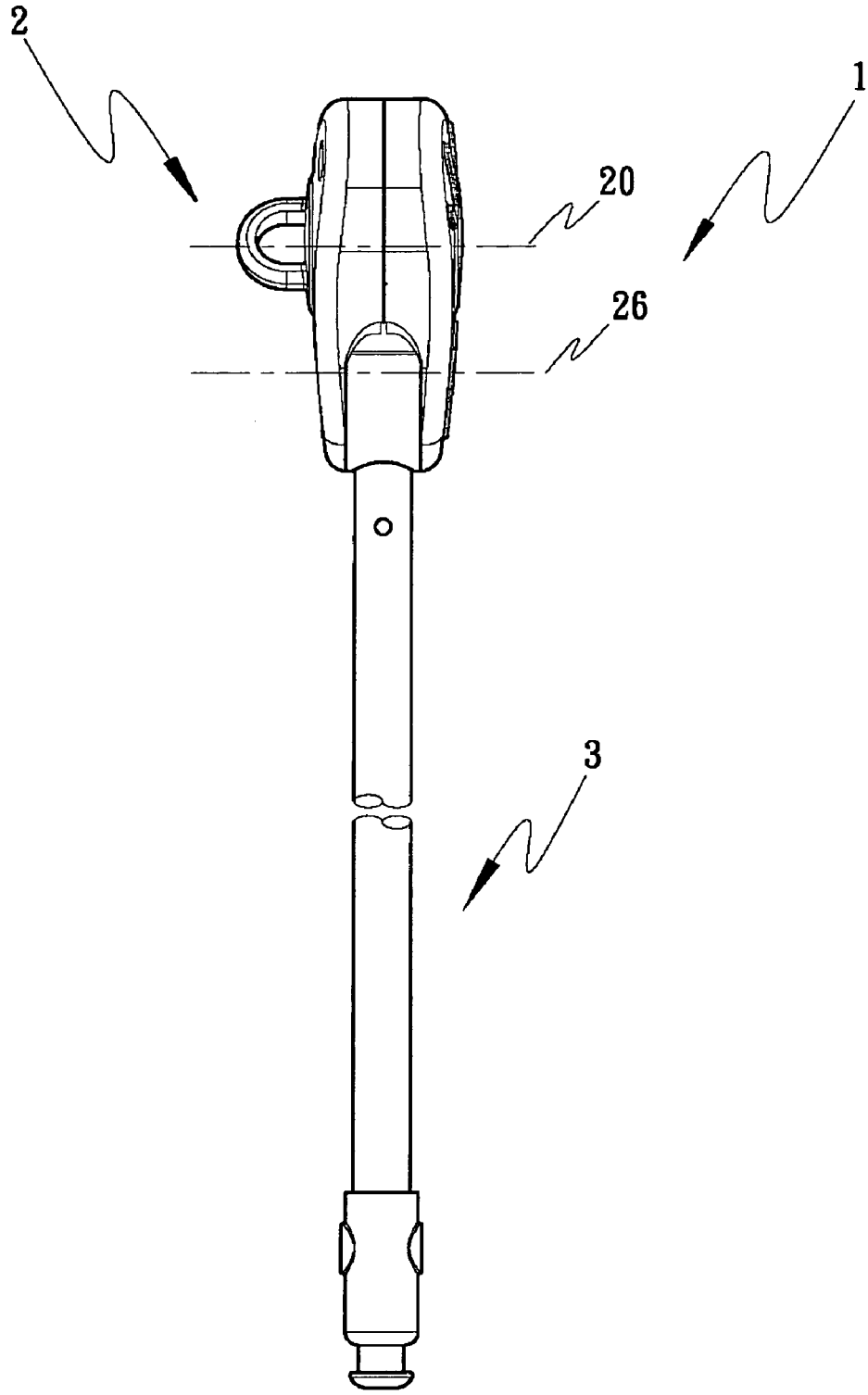
FIG. 5 is a side view of the present invention after being folded.

Because the securing grooves 23 and the connecting portions 24 of the center housing 2 are evenly distributed, the fixed hanging strut 31 and the moveable hanging struts 32 are presented in radial form when the toy support structure 1 is extended (as shown in FIG. 3). When the toy support structure 1 is to be folded, the moveable hanging struts 32 on the two sides rotate toward the fixed hanging strut 31 and are folded in juxtaposition (as shown in FIG. 4) such that the center housing 2, the moveable hanging struts and 32 the fixed hanging strut 31 are arranged in parallel on the same plane (as shown in FIG. 5). Thus, the circular arrangement of the hanging support set 3 is overcome so as to save space and make it easy for the user to store.

What is claimed is:

1. A toy support structure foldable so as to reduce size, as well as extendable so as to be placed above a baby to hang toys for entertainment, said toy support structure comprising:

a center housing having a plurality of connecting portions for rotatably connecting to pivots, wherein an axle center of said pivots is parallel to an axle center of said center housing; and a hanging support set having a fixed hanging strut and a plurality of moveable hanging struts, a lower end of said hanging struts capable of being placed on other objects, an upper end of said moveable hanging struts connected to said pivots, an upper end of the fixed hanging strut connected to the center housing and extending radially from the axle center of said center housing, when folded, said moveable hanging struts rotatable in relation to said pivots so as to be arranged in parallel on same plane extending radially from the axle centers of the pivots and of the center housing.

2. The toy support structure of claim 1, wherein said center housing an upper housing and a lower housing.

3. The toy support structure of claim 2, wherein said lower housing is provided with securing grooves to fix the fixed hanging strut to extend in the same plane and the two sides of said securing grooves are provided with connecting portions, with the pivots comprising an annular member received on the axle centers of the pivots.

4. The toy support structure of claim 3, wherein positioning grooves in a circular arrangement are provided on said pivots concentric to the axle center of said pivots.

5. The toy support structure of claim 4, wherein said upper housing is provided with positioning protrusions in a circular arrangement corresponding to said positioning grooves for positioning said moveable hanging struts when extended or folded.

6. The toy support structure of claim 2, wherein a hanging portion is provided on the said lower housing for hanging toys.

7. The toy support structure of claim 1, wherein said fixed hanging strut is fixedly connected to a securing groove of the center housing, while each of said moveable hanging struts are connected to one of said pivots so as to rotate in relation to said pivot, with the pivots comprising an annular member received on the axle centers of the pivots.

8. The toy support structure of claim 7, wherein when said moveable hanging struts are folded, said moveable hanging struts on the two sides rotate towards said fixed hanging strut and are arranged in juxtaposition.

9. The toy support structure of claim 1, wherein a connecting element is provided at the lower end of said hanging struts so as to connect other objects.

* * * * *